United States Patent [19]

Boris

[11] 4,391,780

[45] Jul. 5, 1983

[54] CONTAINER FOR SAMPLE TESTING

[75] Inventor: Michael J. Boris, Yorba Linda, Calif.

[73] Assignee: Beckman Instruments, Inc., Fullerton, Calif.

[21] Appl. No.: 280,766

[22] Filed: Jul. 6, 1981

[51] Int. Cl.[3] ..... B01L 3/00

[52] U.S. Cl. ..... 422/102; 220/23.8; 422/104

[58] Field of Search ..... 422/102, 104; 220/23.4, 220/23.8; 215/6; 435/296, 809; 128/272, 272.1; 73/864.91, 426, 429; 211/74

[56] References Cited

U.S. PATENT DOCUMENTS

| | | | |
|---|---|---|---|
| 3,142,385 | 7/1964 | Kahlenberg | 211/74 |
| 3,405,706 | 10/1968 | Cinqualbre | 128/2 |
| 3,722,502 | 3/1973 | Besuner et al. | 128/2 F |
| 3,787,290 | 1/1974 | Kaye | 435/293 |
| 3,865,548 | 2/1975 | Padawer | 23/230 R |
| 4,038,149 | 7/1977 | Liner et al. | 195/127 |
| 4,125,376 | 11/1978 | Razulis | 23/230 R |
| 4,154,109 | 5/1979 | Kelson | 73/429 |
| 4,181,121 | 1/1980 | Schwoboda et al. | 128/762 |
| 4,206,767 | 6/1980 | Wingrove | 128/762 |
| 4,218,534 | 8/1980 | LaBelle et al. | 435/5 |
| 4,233,032 | 11/1980 | Statland et al. | 23/230 B |
| 4,237,096 | 12/1980 | Popoff et al. | 422/102 |
| 4,290,534 | 9/1981 | Percappio | 215/247 |

*Primary Examiner*—Michael S. Marcus

*Attorney, Agent, or Firm*—R. J. Steinmeyer; J. E. Vanderburgh; Timothy R. Schulte

[57] ABSTRACT

A container for comparative testing of a sample substance. The container includes a plurality of side-by-side compartments into which a sample substance may be injected. A cover and seal protect the compartments from the outside atmosphere. A sample substance may be injected through the cover and the seal which then reseals itself upon withdrawal of the injecting probe. Level indicator lines on each compartment provide an indicator to ensure the exact amounts of substance being placed in each compartment.

3 Claims, 5 Drawing Figures

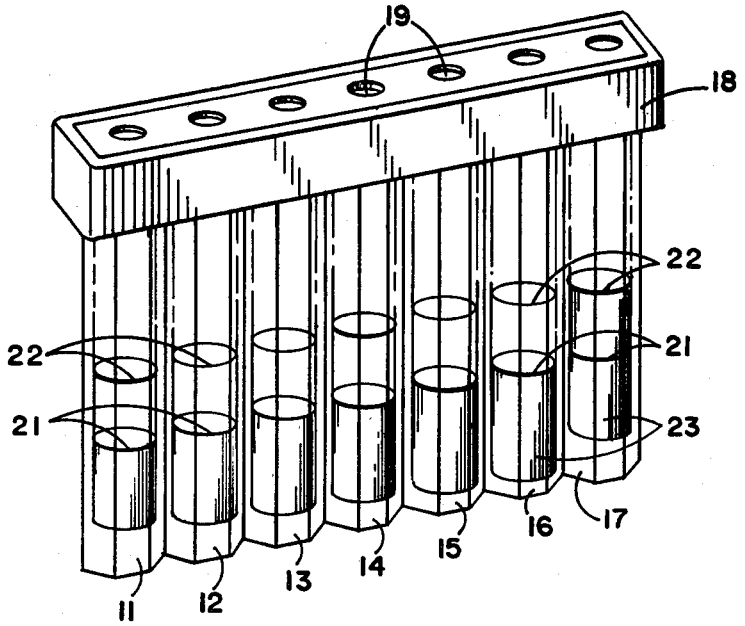
FIG. 1
FIG. 2
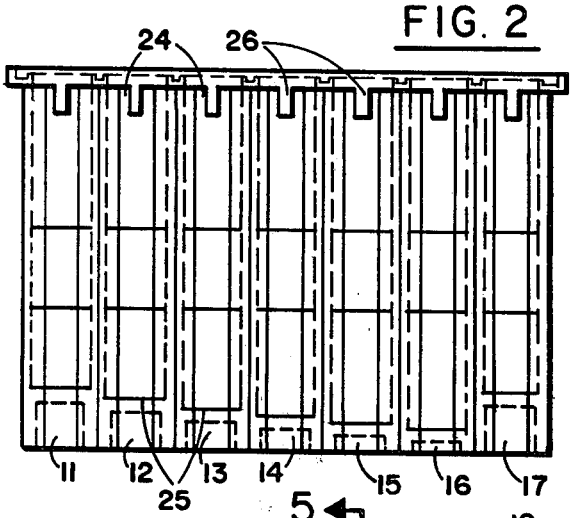
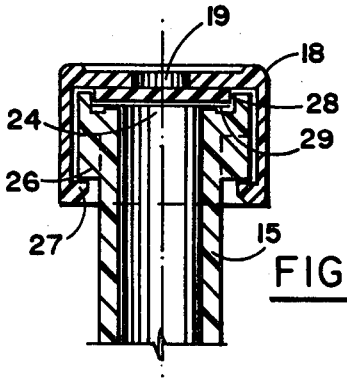
FIG. 5
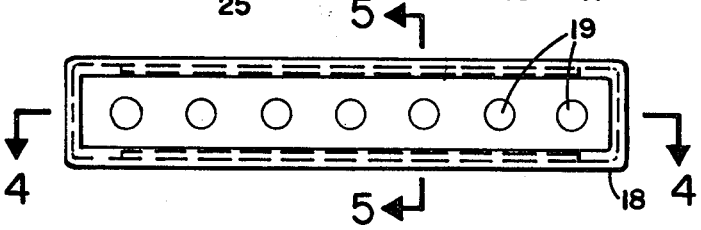
FIG. 3
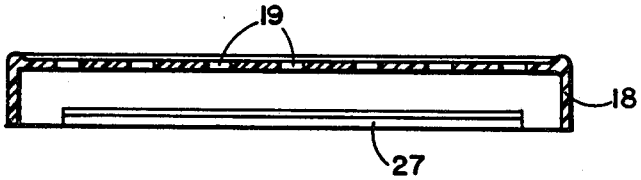
FIG. 4

CONTAINER FOR SAMPLE TESTING

BACKGROUND OF THE INVENTION

1. Field of the Invention

This invention relates to the field of sample test containers. More particularly, the invention relates to a container which allows side-by-side comparison of physical characteristics of sample substances. By way of further characterization, but not by way of limitation thereto, the invention includes a plurality of compartments with a liquid and air-tight seal on one end designed to allow penetration by a probe to inject sample material into the compartments.

2. Description of the Prior Art

Hyaline membrane disease is caused in part by inadequate synthesis of surface-tension lowering material (surfactant) by the lung. Neonatal hyaline membrane disease represents a major cause of infant mortality. A fetal lung maturity test is described in U.S. Pat. No. 4,233,032 issued to B. E. Statland et al. on Nov. 11, 1980. This patent discloses a simple, rapid test with easy to interpret results. The test comprises mixing a fixed predetermined volume of amniotic fluid with a 95% aqueous ethanol solution in graduated amounts. The vials are all shaken in a reproducible manner and the highest ethanol volume fraction showing a stable foam is reported.

In order to properly conduct the test described above, it is necessary to shake the amniotic fluid mixture very vigorously. The graduated ethanol amounts provide a range of results which indicate the level of lung maturity. If separate vials are used, it is necessary to monitor the amount of shaking to ensure that all vials are agitated equally. In addition, because precise amounts of amniotic fluid and ethanol are required, extreme care must be taken to ensure that exact amounts of these substances are injected into the vial. In addition, the amount of foam in each vial must be compared with that in the other vials in order to accurately determine lung maturity. These side-by-side comparisons may be difficult when separate vials are used.

SUMMARY OF THE INVENTION

The invention is a container which includes a plurality of compartments which allow side-by-side comparison of physical characteristics of the substances contained therein. The container cooperates with a cover to provide a liquid and air-tight seal. The cover is structured to allow injection of a sample material into the compartments without destroying the seal. A plurality of level lines are included on the compartment to ensure that precise amounts of the various substances are introduced into the compartments.

BRIEF DESCRIPTION OF THE DRAWINGS

FIG. 1 is a perspective view of the invention;

FIG. 2 is a side view of the container with the cover removed;

FIG. 3 is a top view of the container illustrating the cover;

FIG. 4 is a sectional view through 4—4 of FIG. 3; and

FIG. 5 is a sectional view through 5—5 of FIG. 3.

DESCRIPTION OF THE PREFERRED EMBODIMENT

FIG. 1 is a perspective view of the container including a plurality of compartments 11–17. A cover 18 is positioned on compartments 11–17. A plurality of access openings 19 are included on cover 18. A plurality of lower level indicators 21 and upper levels indicators 22 are provided for each of the compartments 11–17, preferably as scribe marks on the wall of each of compartments 11–17. A testing liquid 23 which may be ethanol is stored in containers 11–16. A control liquid, which may include ethanol, is stored in container 17.

Referring to FIG. 2, a side view of compartments 11–17 is shown. Each of compartments 11–17 includes an open end 24 and a closed end 25 which, when combined with the walls of compartments 11–17, define a predetermined volume within each of compartments 11–17. The cross-sectional areas of tubularly shaped compartments 11 through 17 are the same. A raised rib 26 on each of compartments 11–17 cooperates with cover 18 to secure cover 18 to compartments 11–17.

Referring to FIG. 3, a top view of the container shown in FIG. 1 is illustrated. Access openings 19 are shown on cover 18.

Referring to FIG. 4, a side sectional view through 4—4 in FIG. 3 is shown. Access openings 19 in cover 18 are illustrated. A ridge 27 cooperates with raised ribs 26 (FIG. 2) to secure cover 18 to compartments 11–17.

Referring to FIG. 5, a sectional view through 5—5 in FIG. 3 is shown. Access opening 19 in cover 18 is positioned adjacent opening 24 of compartment 15. A resilient or self sealing layer which may include a sheet 28 of an elastomeric material such as silicone rubber and a protective layer which may include a metallic foil layer 29 are positioned between cover 18 and open end 24 of compartment 15.

Mode of Operation

The fetal lung maturity test as described in U.S. Pat. No. 4,233,032 referred to above may be performed using the invention herein described. Referring to FIG. 1, a liquid 23, which may be ethanol, is placed in compartments 11–16 to the desired levels. Compartment 17, acting as a control test, is filled to the upper level indicator 22 with a control liquid which may include some ethanol. Compartments 11–16 are filled to lower level indicator 21 with ethanol. Because closed ends 25 in compartments 11–16 are of varying distances from open ends 24 in compartments 11–16, various amounts of ethanol are included in each compartment.

Cover 18 is engaged with compartments 11–17 by the interaction of raised rib 26 and ridge 27. Between cover 18 and compartments 11–17 a protective layer 29 and an elastomeric layer 28 are included. That is, a strip of metallic foil coated with a layer of plastic is placed adjacent open ends 24 with elastomeric layer 28 then placed thereon. The purpose of protective layer 29 is to prevent the ethanol or other substance within compartments 11–17 from degrading elastomer layer 28.

Referring to FIG. 5, when cover 18 is secured on the compartments 11–17, protective layer 29 and elastomer layer 28 are held in place. Access opening 19 in cover 18 is positioned over open end 24 of compartment 15.

When it is desired to perform the test, a probe may be inserted into the volumes defined by compartments 11–17. That is, a probe may be inserted through access openings 19 in cover 18. This probe would penetrate elastomer layer 28 and protective layer 29 such that the tip of the probe would be inside the predetermined volume defined by compartments 11–17. The amniotic fluid or other substance may then be injected into the compartments to the desired level. Preferably, upper level indicators 22 provide an indication of the desired level of amniotic fluid added to each compartment. Thus, because the distances between lower level indicator 21 and upper level indicator 22 are the same in each of compartments 11–16, the level of amniotic fluid added to each compartment will be the same. However, because the distance of lower level indicator 21 and closed end 24 in each of compartments 11–16 is different, the amount of ethanol 23 included in each compartment varies. Thus, the same amount of amniotic fluid is combined with a different amount of ethanol in each compartment. Withdrawal of the probe through access opening 19 results in sealing of elastomer layer 28 due to the physical characteristics of that substance. That is, withdrawal of the probe through elastomer layer 28 results in expansion of the layer into the hole caused by the puncture of the probe. While protective layer 29 does not reseal, the contact of sample liquids with elastomer layer 28 is acceptable for the relatively short period of time required to perform the test. Thus, protective layer 29 has performed its function to protect elastomer layer 28 during the storage period when the ethanol 23 was contained in compartments 11–17. The resiliency of elastomer layer 28 also results in its continued contact with the probe as it is being withdrawn. This contact serves to wipe excess amniotic fluid from the tip of the probe as it is withdrawn.

Referring to FIG. 1, once amniotic fluid has been added to compartments 11–16 to upper level indicator 22, the test may be conducted. That is, A fluid-tight seal is maintained between the sample liquids within containers 11–17 and the outside atmosphere. Thus, vigorous shaking may be employed to properly conduct the test without danger of contamination either from one compartment to the next or from any compartment to the outside atmosphere. Because compartments 11–17 are positioned adjacent one another side by side, it is possible to compare the amounts of foam generated in each compartment with respect to each of the other compartments. Thus, an accurate determination may be made of the relative amounts of foam. From this, the lung maturity of a fetus may be determined as discussed in the patent previously referred to. The use of graduated closed ends 24 in each of compartments 11–17 allows this comparison to be made without the necessity of measuring the amounts of foam generated in each compartment. That is, if the compartments were separate, they would have to be somehow placed side by side at the same level to allow comparison of the foam amounts. In addition, because of the graduated closed ends, different amounts of ethanol 23 may be introduced while still maintaining equal levels at lower level indicator 21. In the embodiment shown in FIG. 1, compartment 17 is illustrated with the control liquid which may be partly ethanol 23 filled to upper level indicator 22. This is because compartment 17 may be used as a control compartment. The use of the resealable elastomer seal 28 allows the sample liquid to be introduced into the compartments without the necessity of removing cover 18. This allows cover 18 to be securely fastened to the compartments such that the integrity of the liquid-tight seal is maintained at all times. This sealing mechanism allows ethanol 23 to be added at the factory prior to shipment, thus ensuring more accurate volume control.

While particular forms of the invention have been disclosed with respect to a specific embodiment thereof, it is not to be so limited as changes and modifications may be made which are within the full intended scope of the invention as defined by the appended claims. For example, while silicone rubber has been disclosed as the elastomer layer 28, it should be expressly understood that any type elastomer may be used. In addition, protective layer 29 may be other than plastic-covered foil. In addition, any type of interlocking design may be used for cover 18 and compartments 11–17 other than raised ribs 26 and ridge 27 employed in the present invention. Also, while upper level indicators 22 and lower level indicators 21 are employed in the present invention, it should be expressly understood that more or fewer level indicators may be used depending upon the type and quantity of sample liquids to be tested.

The foregoing description, taken together with the appended claims, constitutes a disclosure which enables one skilled in the art and having the benefits of the teachings contained therein to make and use the invention. Further, the structure herein described constitutes a meritorious advance in the art which is unobvious to such skilled workers not having the benefit of these teachings.

What is claimed is:

1. Apparatus for comparative testing of a sample substance comprising:

a unitary structure including a single row of at least four tubularly shaped compartments joined side by side along said single row, each said compartment having the same cross sectional area, each said compartment including an upper open end and a lower closed end spaced from said upper open end graduated distances such that at least three of said compartments define successively increasing or decreasing volumes as measured from the other of said compartments which is a control compartment;

a layer of self sealing elastomeric material placed over said open ends for sealing each said compartment from adjacent compartments and from the outside atmosphere;

a protective layer positioned between said open ends and said elastomeric material;

a cover connectable to said compartments adjacent said open end, said cover and said upper end of said compartments cooperating to position and compress said elastomeric material and said protective layer, said cover including access openings, one access opening for each compartment, each said access opening in line with its corresponding open end such that a probe may be inserted through each said access opening, said elastomeric material, and said protective layer to enter said compartment; and at least one level line on each said compartment, each said level line being spaced from said open end a predetermined distance such that at least some of said level lines are spaced different distances from said lower closed end.

2. Apparatus according to claim 1 wherein said level lines includes an upper level indicator and a lower level indicator on each of said compartments.

3. Apparatus according to claim 1 wherein said protective layer includes a layer of plastic covered metallic foil.

* * * * *